US006537119B2

(12) United States Patent
Deslauriers

(10) Patent No.: US 6,537,119 B2
(45) Date of Patent: Mar. 25, 2003

(54) PERSONAL FLOATATION DEVICE

(76) Inventor: Julien Pascal Deslauriers, P.O. Box 41, St-Sauveur-des-Monts Quebec (CA), J0R 1R0

( * ) Notice: Subject to any disclaimer, the term of this patent is extended or adjusted under 35 U.S.C. 154(b) by 0 days.

(21) Appl. No.: 09/866,634

(22) Filed: May 30, 2001

(65) Prior Publication Data

US 2002/0002020 A1 Jan. 3, 2002

Related U.S. Application Data

(63) Continuation-in-part of application No. 09/518,168, filed on Mar. 2, 2000, now abandoned.

(51) Int. Cl.[7] ..... B63C 9/30
(52) U.S. Cl. ..... 441/106; 441/117; 441/123
(58) Field of Search ..... 441/106, 114, 441/115, 116, 117, 118, 120, 123, 124, 129

(56) References Cited

U.S. PATENT DOCUMENTS 1,272,336 A 7/1918 Edmonds
3,903,555 A * 9/1975 Busby ..... 441/116
4,038,713 A 8/1977 O'Link
4,131,974 A * 1/1979 Bolton et al. ..... 441/118
4,272,857 A 6/1981 Oldham
5,030,153 A * 7/1991 Bailey ..... 441/106
5,152,706 A 10/1992 Fister
6,089,936 A * 7/2000 Hoffman ..... 441/117

* cited by examiner

*Primary Examiner*—Stephen Avila
(74) *Attorney, Agent, or Firm*—Ogilvy Renault; Robert Mitchell

(57) ABSTRACT

A personal floatation device comprises a wide buoyant collar hinged to a thoracic float. The collar has a front portion projecting forwardly under the chin of the wearer to cooperate with the thoracic float to limit forward tilting movements of the wearer's head. The hinge between the collar and the thoracic floater provides for the combination of the buoyancy of the collar and the thoracic float when a wearer fall face down in the water. The juxtaposition of the collar and the thoracic float contributes to rapidly pivot the wearer's head out of the water. A buoyant flap is articulated to a rear end of the collar so as to be only responsive to backward movements of the wearer's upper body.

20 Claims, 4 Drawing Sheets

PERSONAL FLOATATION DEVICE

RELATED APPLICATIONS

This Application is a Continuation-In-Part of U.S. application Ser. No. 09/518,168 filed on Mar. 2, 2000, abandoned.

BACKGROUND OF THE INVENTION

1. Field of the Invention

The present invention is directed to a personal floatation device which is particularly adapted for use by persons with disabilities.

2. Description of the Prior Art

Over the years various life vests or personal floatation devices have been developed for keeping a wearer afloat in a body of water.

For instance, U.S. Pat. No. 3,903,555 issued on Sep. 9, 1975 to Busby and U.S. Pat. No. 4,038,713 issued on Aug. 2, 1977 to O'Link both disclose a personal floatation device comprising a front floatation member and a buoyant collar. The collar comprises front and rear collar sections pivotally secured to each other on an axis extending diametrically of a neck receiving opening defined in the collar.

Although the devices described in the abovementioned patent are effective, it has been found that there is a need for a new personal floatation device particularly adapted for use by non-autonomous persons or person that are loosing their autonomy.

SUMMARY OF THE INVENTION

It is therefore an aim of the present invention to provide a personal floatation device which is adapted to stabilize a person in a body of water.

It is also an aim of the present invention to provide a personal floatation device which is particularly adapted for use by handicapped individuals.

It is a further aim of the present invention to provide a personal floatation device which is adapted to urge the wearer into a generally stable face up position.

It is a still further aim of the present invention to provide such a personal floatation device which is comfortable to wear while in the water.

Therefore, in accordance with the present invention, there is provided a personal floatation device comprising a front floatation member adapted to generally overlay a wearer's chest region, a collar floatation member adapted to at least partly surround a neck region of the wearer, said collar floatation member being articulated to said front floatation member for relative movement with respect thereto between a first position wherein a front portion of said collar floatation member and said front floatation member are at least partly in juxtaposition so as to work in tandem to make use of the combined floatation capacity thereof, and a second position wherein said collar floatation member extends at an angle relative to said front floatation member to safely maintain the head of the wearer substantially above water, and a harness for attaching said front floatation member and said collar floatation member on the wearer's body.

In accordance with a further general aspect of the present invention, there is provided a personal floatation device comprising a collar floatation member adapted to be worn at a neck region of a wearer to provide buoyant support, a front floatation member adapted to be worn at a chest region of the wearer, said front floatation device having right and left sides, said left side having a different buoyancy than that of said right side to create a controlled imbalance so as to turn an unconscious wearer from a face down position to a face up position in which the wearer floats on his back with the head thereof lying on the collar floatation member above water.

In accordance with a further general aspect of the present invention, there is provided a personal floatation device comprising a head support member made of a buoyant material for supporting a wearer head above water, said head support member having a rear section adapted to extend rearwardly of the nape of the wearer's neck, and a buoyant flap movably mounted to a distal end portion of said rear section so as to normally float freely on the water while still being responsive to backward movements of the wearer's head and upper body for cooperating with said rear section in supporting the head of the wearer above water.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
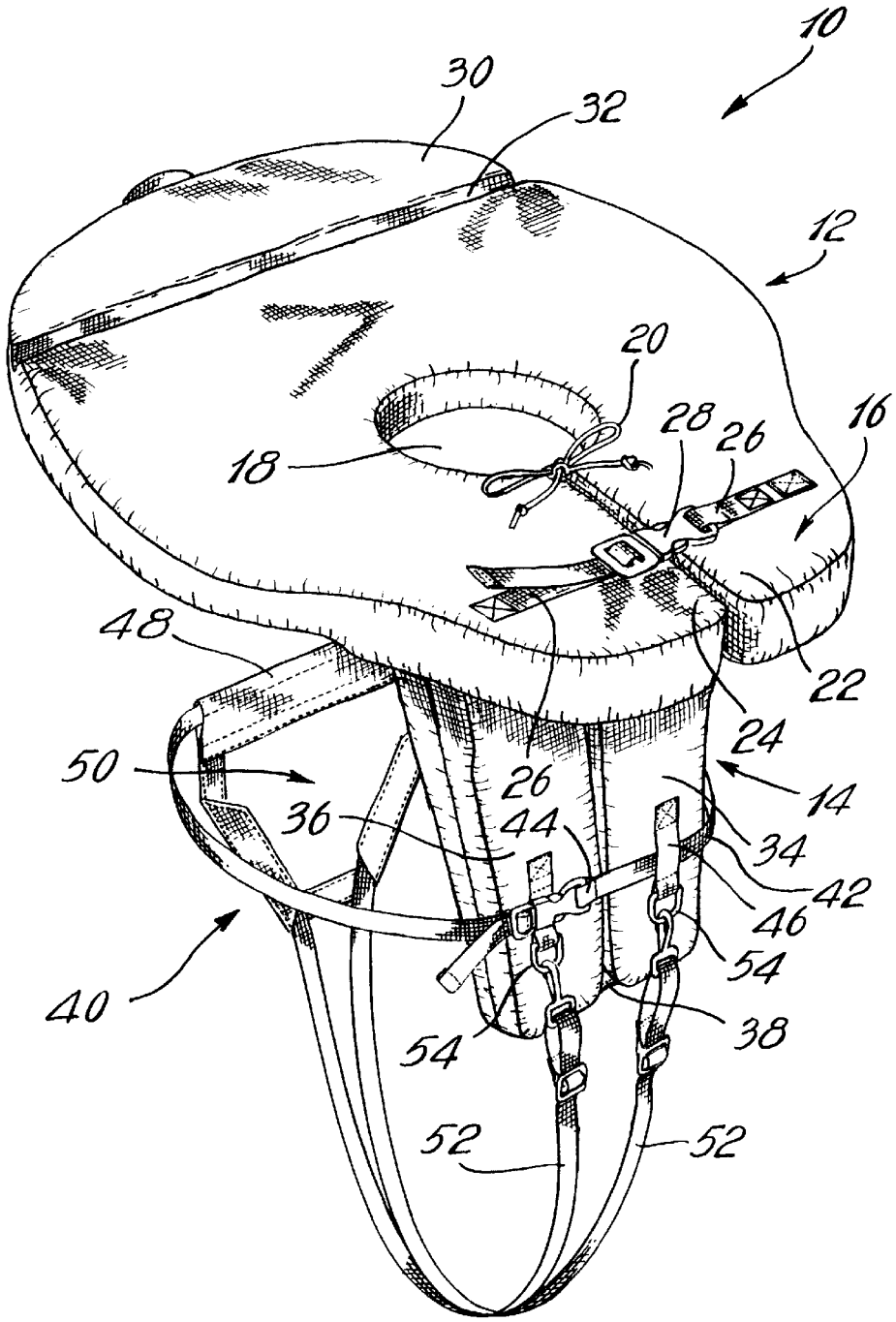
FIG. 1 is a perspective view of a personal floatation device comprising a collar floatation member and a thoracic floatation member in accordance with a preferred embodiment of the present invention.

Now referring to the drawings, and in particular to FIG. 1, a personal floatation device embodying the elements of the present invention and generally designated by the numeral 10 will be described. As will be seen hereinafter, the personal floatation device 10 is particularly adapted for use by persons with disabilities, such as lost of mobility, in order to provide adequate floating support and stability when the wearer is in a body of water.

More specifically, the personal floatation device 10 generally comprises a wide or oversized collar floatation member 12 for completely surrounding a wearers' neck and overlaying the shoulder thereof, and a thoracic floatation member 14 for covering the wearer's chest. The collar floatation member 12 is hingedly connected to an upper end portion of the thoracic floatation member 14 by means of a pair of sturdy fabric strips (not shown). Each strip can be sewn at a first end thereof to an undersurface of the collar floatation member 12 and at a second opposed end thereof to a front surface of the thoracic floatation member 14. However, it is noted that the so formed hinge can be placed in front or at the back of the thoracic floatation member 14. This does not affect the combined reverting capability of the collar floatation member 12 and the thoracic floatation member 14.

Figure 3:
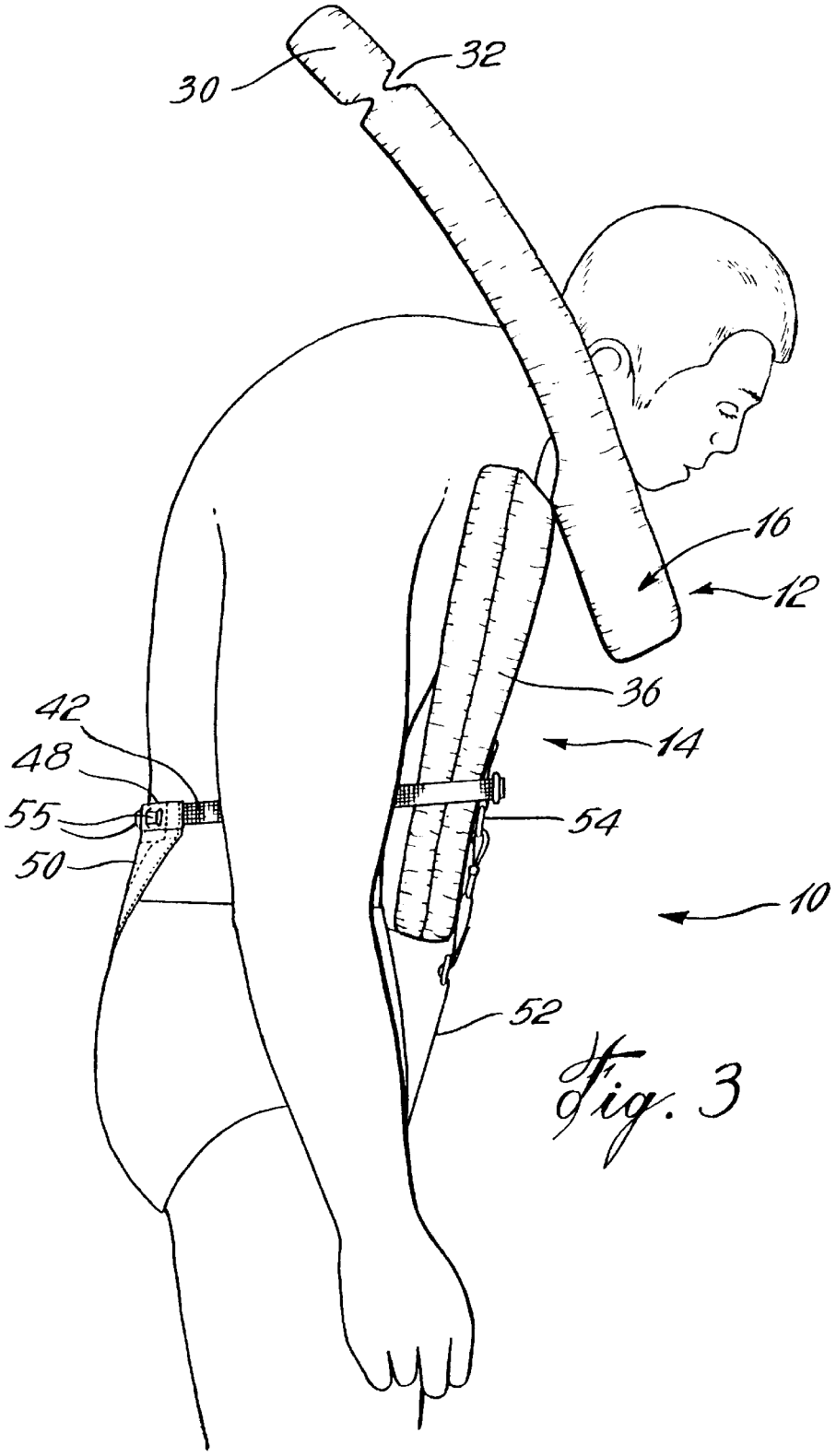
FIG. 3 is a side elevational view illustrating how the collar floatation member cooperates with the thoracic floatation member to prevent the head of the wearer from falling forward into a water body.

The articulation between the collar floatation member 12 and the thoracic floatation member 14 provides for the juxtaposition of a forwardly projection portion 16 of the collar floatation member 12 and the thoracic floatation member 14. As seen in FIG. 3, this results in the combination of the thickness of the forwardly projecting portion 16 of the collar floatation member 12 and the thoracic floatation member 14 under the chin of a wearer and at the level of the wearer's shoulders. This combination of thickness prevents the wearer's head from falling forward into the water and double the buoyancy of the device. Indeed, the thoracic floatation member 14 acts as a front stopper for the collar floatation member 12. Furthermore, in the event that the wearer's falls face down in a body of water, the addition of thickness resulting from the juxtaposition of the forwardly projecting portion 16 of the collar floatation member 12 and the thoracic floater 14 will provide increased buoyancy and, thus, contribute to rapidly pivot the wearer's head backward out of the water. This aspect of the present invention is also advantageous in that it allows for the utilization of a thinner thoracic floatation member which contributes to afford increased freedom of movements for the wearer in the water. The principal purpose of the hinge between the collar floatation member 12 and the thoracic floatation member 14 is to allow them to work in tandem to make use of their combined buoyant capacity without increasing the thickness of the thoracic floatation member 14. It is noted that by placing the hinge at the rear of the thoracic floatation member 14 instead of at the front thereof, as illustrated in FIG. 3, the moment arm is increased which further contributes to prevent the wearer's head from falling forward.

As seen in FIG. 1, the collar floatation member 12 defines a central opening 18 sized for receiving the neck of a wearer. A draw string 20 runs into a first eyelet (not shown), through a draw string passage (not shown) extending about the central opening and then out a second eyelet (not shown). This arrangement provides for the adjustment of the size of the central opening 18. Indeed, this adjustment provides for a personal adjustment of the collar floatation member 12 to various morphologies. It also helps to maintain the face of the wearer out of the water. The forwardly projecting portion 16 of the collar floatation member 12 is split in first and second adjacent end portions 22 and 24 adapted to be spread apart for allowing the collar floatation member 12 to be easily fitted about the wearer's neck. The draw string 20 allows to readily secure the end portions 22 and 24 together about the wearer's neck. A pair of flexible straps 26 equipped with adjustable cooperating fasteners 28, such as buckles, are stitched or otherwise secured to respective first and second end portions 22 and 24 for further releasably securing the collar floatation member 12 in a closed disc configuration about the wearer's neck.

The collar floatation member 12 is sized and dimensioned so as to extend forwardly, rearwardly and laterally of the wearer to a distance sufficient to provide enhance stability to the wearer while in the water. The wide collar floatation member 12 or oversized head cushion is designed to resist to involuntary contortions or to reflexes of epileptic or spastic persons. It is designed to resist to the force of a backward movement of the head, and to fetal position that lends to rotate the body sideways. Furthermore, the collar floatation member 12 by its configuration prevents water from getting into the eyes of the wearer, thus, increasing the safety feeling.

The collar floatation member 12 and the thoracic floatation member 14 are each preferably made from two layers of textile fabric, such as nylon, or other suitable material, with a layer of buoyant material, such as closed-cell foam plastics, sandwiched therebetween. The closed-cell foam can be provided in block or in the form of superposed strips. The fabric material covering the buoyant material is optional.

Figure 2:
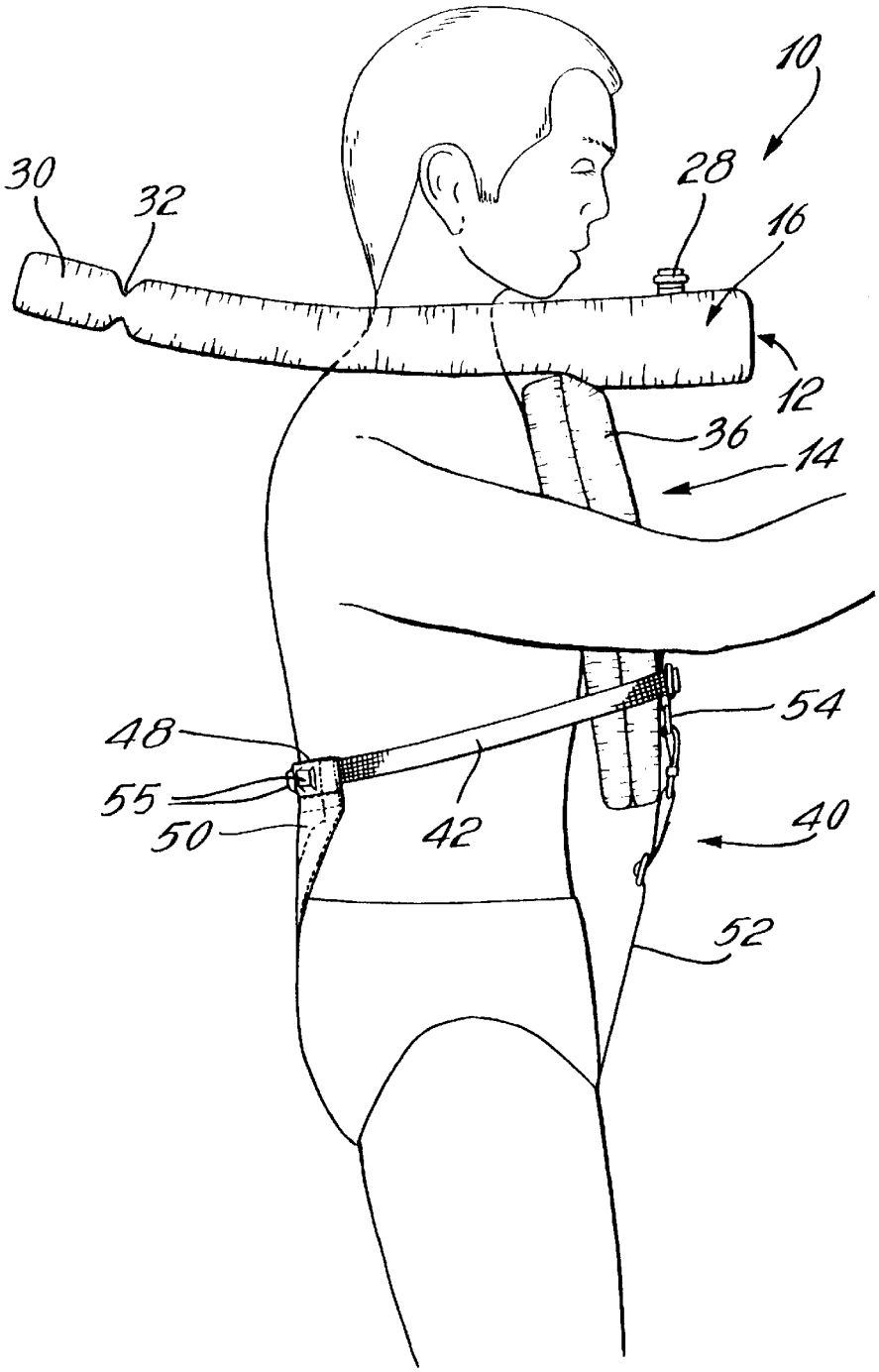
FIG. 2 is a side elevational view of the personal floatation device worn by a person, illustrating the normal position of the collar floatation member relative to the thoracic floatation member to buoyantly support the wearer in a body of water.
Figure 4:
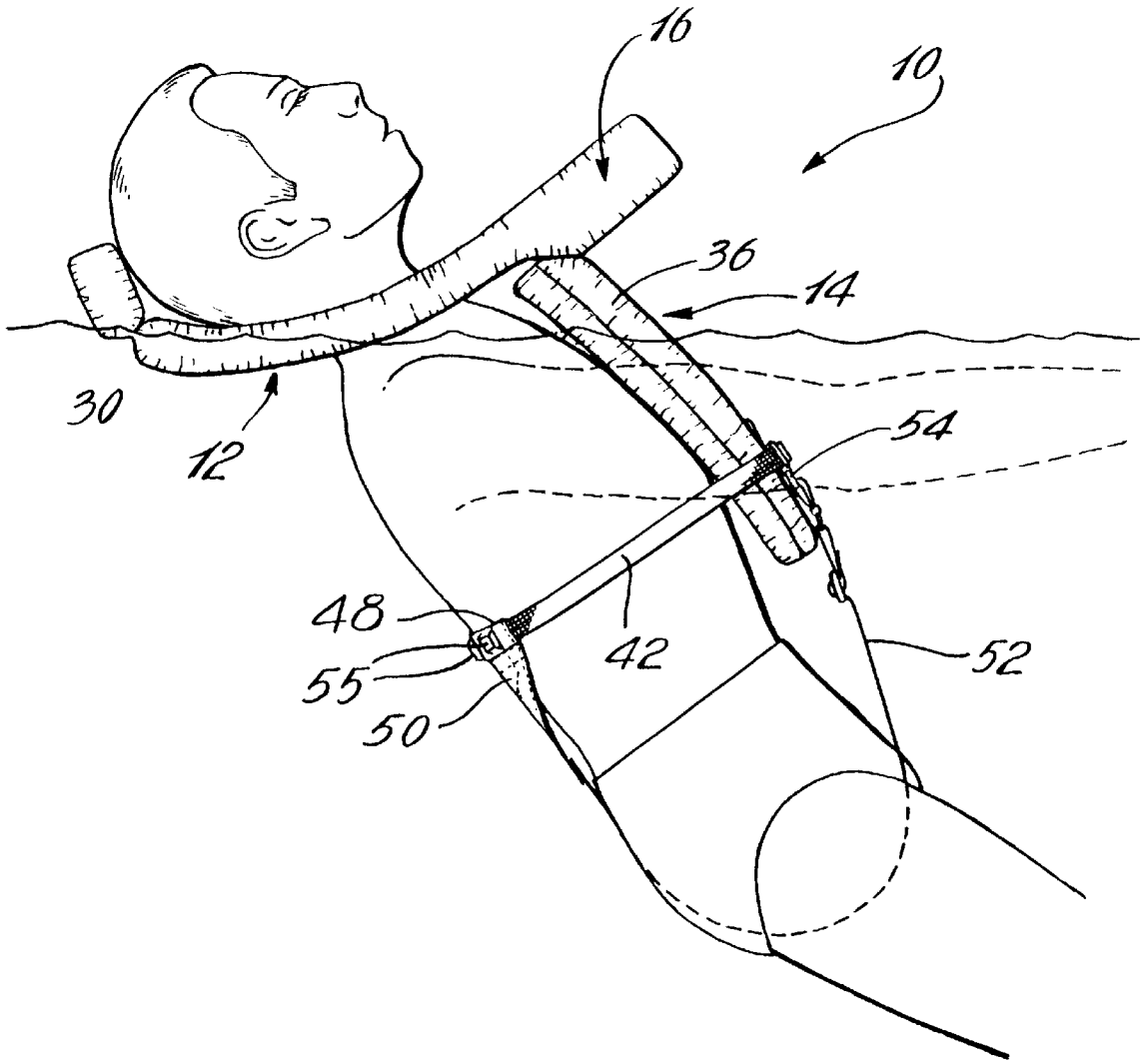
FIG. 4 is a side elevational view illustrating a flap provided at a rear end of the collar floatation member in an operative position thereof.

As shown in FIG. 1, the collar floatation member 12 includes two separate pieces of buoyant material, i.e. a main piece and a secondary piece, enclosed in a same envelope of fabric material so as to form a movable flap 30 at a rear end portion of the main buoyant piece of the collar floatation member 12. Alternatively, in the case where the two separate pieces are not covered by a fabric material, they could be pivotally connected by a strip of flexible material. The flap 30 is hinged to the main buoyant piece of the collar floatation member 12 on an axis 32 that extends transversely of the collar. While the wearer is assuming a generally upstanding position in the water, as illustrated in FIG. 2, the flap 30 floats freely on the water, thereby preventing the transmission of stresses to the nape of the wearer's neck. However, if the wearer arches his back or tilts back his head (see FIG. 4), the flap 30 becomes effective and cooperates with the portion of the main buoyant piece extending rearwardly of the neck of the wearer to oppose such movements and buoyantly support the wearer's head above water. As seen in FIG. 4, when a pressure is exerted on the flap 30 by the wearer's head, the flap 30 pivots upwardly about the axis 32 to counteract the backward movement of the wearer's head. If the flap 30 was not movable, it would result in stresses being transmitted to the back of the wearer's neck, which would, in turn, incites the wearer to tilt his/her head backward. By dividing the rear portion of the collar floatation member 12 in two parts, the tension at the level of the nape of the neck is virtually eliminated. Without tension at that point, the head will lie horizontally, thus increasing the floatation level of the lower body. The flap 30 is also intended to prevent the level of water from reaching the arch of the eyebrows of the wearer.

As shown in FIGS. 1 to 4, the portion of the collar floatation member 12 located forwardly of the point of attachment of the thoracic floatation member 14 to the collar floatation member 12 is thicker than the remaining portion thereof. This increased thickness provides a lever arm for pivoting the head of a wearer from the position illustrated in FIG. 3 to the position illustrated in FIG. 2, while the wearer is in the water.

As shown in FIG. 1, the thoracic floatation member 14 includes a right-hand buoyant member 34 and a left-hand buoyant member 36 interconnected to each other at 38 and at respective upper ends thereof via the collar floatation member 12. The thickness of each buoyant member 34/36 gradually decreases towards a lower end thereof. According to an aspect of the present invention, the thickness of buoyant material of the right and left buoyant members 34 and 36 is different so as to create a controlled imbalance in order to rapidly revert an unconscious wearer from a face down position to a face up position in which the unconscious wearer lies on his back with his/her face kept out of the water by the collar floatation member 12. In a preferred embodiment of the present invention, the right buoyant member 34 has more buoyant material than the left buoyant 36, thereby facilitating the pivot of the wearer about the longitudinal axis of his/her body.

The shape and the configuration of the buoyant members 34 and 36 establish the center of gravity of the floating line higher than the center of gravity of the wearer.

As shown in FIG. 4, the collar floatation member 12 provides a resting surface against which the back of the head of the wearer can rest near the level of water, thereby improving the level of floatation of the lower portion of the wearer's body and the comfort of the wearer. The thoracic floatation member 14 also permits to the wearer's body to stay close to the surface of the water body, which favors an upstanding position. By so biasing the wearer's body to an upstanding position, the support afforded by the body of water itself is increased so that the wearer's body is essentially supported by the water and stabilized by the device 10. This advantageously improves the comfort of the wearer in the water.

As illustrated in FIG. 1, the personal floatation device 10 further includes a strap assembly or harness 40 for releasably attaching the thoracic floatation member 14 and, thus, the collar floatation member 12 to the wearer's body.

The strap assembly 40 includes a waist belt 42 secured at 44 to a side of the left buoyant member 36. The buoyant members 34 and 36 have a length such that the waist belt 42 remains at the small of the back. The waist belt 42 extends through a belt loop 46 secured to the right buoyant member 34 and then through a belt receiving passage 48 defined along the upper edge of a support triangle 50 made of fabric material, such as nylon. The belt loop 46 stabilizes the waist belt 42. The opposed ends of the waist belt 42 are provided with adjustable cooperating fasting, such as buckles, for releasably securing the thoracic floatation member to the upper body portion of persons of different sizes. As seen in FIG. 1, the fastening of the waist belt 42 is off-centered relative to a median axis of the device 10. The off-centered fastening, positioned on one side of the device 10, holds the waist belt firmly in place to adequately and constantly support the wearer and that even if violent and sudden movements occur.

A pair of groin straps 52 extends from the support triangle 50 to respective front surfaces of the right and left floats 34 and 36. Each strap 52 hooks to loop 54 secured to the associated buoyant members 34/36. When adding the waist belt 42 to the groin straps 52, a better horizontal position on the water is achieved. This eliminates stress and strain on the back, the neck and the skin in contact with the straps 52.

The support triangle 50 substitutes for the strap 52 placed at the groin. It is the perfect complement to provide an efficient support for the lower back. It helps to evenly distribute the tensions at the buttock level and to maintain the personal floatation device 10 well adjusted on the user. It also helps to maintain a good support of the lower part of the body of the wearer in a horizontal position. Finally, it is highly recommended for people with a strong scoliosis or wearing diapers.

Optionally, as illustrated in FIG. 2, a series of similar ballast weights 55 can be distributed along the upper edge of the support triangle 50 to favor rapid righting of the wearer by maintaining the lower portion of the wearer's body under the water level. When the personal floatation device 10 is used without the support triangle 50, the ballast weights 55 can be installed at the lower end of the thoracic floatation member 14. This also favors rapid raising of the wearer's head.

The personal floatation device 10 pushes back the capsizing limits of a person, thus rendering it extremely safe.

Finally, it is contemplated to integrate the thoracic floatation member 14 into a vest.

What is claimed is:

1. A personal floatation device comprising a front floatation member adapted to generally overlay a wearer's chest region, a collar floatation member adapted to at least partly surround a neck region of the wearer, said collar floatation member being articulated to said front floatation member for relative movement with respect thereto between a first position wherein a front portion of said collar floatation member and said front floatation member work in tandem to make use of the combined floatation capacity thereof, and a second position wherein said collar floatation member extends at an angle relative to said front floatation member to safely maintain the head of the wearer substantially above water, and a harness for attaching said front floatation member and said collar floatation member on the wearer's body, wherein said collar floatation member is seated on top of said front floatation member with said front portion projecting forwardly of said front floatation member, said front floatation member acting as a stopper to prevent said collar floatation member from collapsing against a front surface of said front floatation member.

2. A personal floatation device as defined in claim 1, wherein said collar floatation member is hinged to said front floatation member for pivotal movement about a pivot axis transversal to said collar floatation member.

3. A personal floatation device as defined in claim 1, wherein said front portion of said collar floatation member projects forwardly of said pivot axis.

4. A personal floatation device as defined in claim 2, wherein said collar floatation member has a thickness, and wherein said thickness increases forwardly of said pivot axis.

5. A personal floatation device as defined in claim 2, wherein said floatation device defines a neck receiving opening, said neck receiving opening extending rearwardly of said pivot axis.

6. A personal floatation device as defined in claim 1, wherein said collar floatation member has a rear portion adapted to extend rearwardly of the nape of the wearer's neck, and a buoyant flap movably mounted to a distal end portion of said rear portion so as to normally float freely on the water while still being responsive to backward movements of the wearer's head and upper body for cooperating with said rear portion in supporting the head of the wearer out of the water.

7. A personal floatation device as defined in claim 6, wherein said f lap and said rear portion are articulated to one another.

8. A personal floatation device as defined in claim 7, wherein said flap and said rear portion are made of separate pieces of buoyant material sandwiched between two interconnected layers of flexible fabric material.

9. A personal floatation device as defined in claim 7, wherein said flap and said rear portion are made of two separate pieces of buoyant material received in a same envelope.

10. A personal floatation device as defined in claim 1, wherein said front floatation member includes right and left thoracic floats, said thoracic floats having a different buoyancy so as to create a controlled imbalance to rapidly turn the wearer's about a longitudinal axis thereof from a face down position to a face up position in which the wearer lies on his/her back.

11. A personal floatation device as defined in claim 1, wherein said harness includes a waist belt with off-centered buckles positioned at a side of the front floatation member at a distance from a median axis of the front floatation member.

12. A personal floatation device as defined in claim 1, wherein said harness includes a waist belt, a back support adapted to overlay a lower back region of the wearer, said waist belt connecting said front floatation member to said back support, and a pair of groin straps adapted to extend between the legs of the wearer from said front floatation member to said back support.

13. A personal floatation device as defined in claim 12 wherein said back support is formed of a triangular piece of fabric material.

14. A personal floatation device comprising a front floatation member adapted to generally overlay a wearer's chest region, a collar floatation member adapted to at least partly surround a neck region of the wearer, said collar floatation member being articulated to said front floatation member for relative movement with respect thereto. wherein said collar floatation member has a rear portion adapted to extend rearwardly of the nape of the wearer's neck, and a buoyant flap movably mounted to a distal end portion of said rear portion so as to normally float freely on the water while still being responsive to backward movements of the wearer's head and upper body for cooperating with said rear portion in supporting the head of the wearer out of the water, and a harness for attaching said front floatation member and said collar floatation member on the wearer's body.

15. A personal floatation device as defined in claim 14, wherein said flap and said rear portion are articulated to one another.

16. A personal floatation device as defined in claim 15, wherein said flap and said rear portion are made of separate pieces of buoyant material sandwiched between two interconnected layers of flexible fabric material.

17. A personal floatation device as defined in claim 15, wherein said flap and said rcar portion are made of two separate pieces of buoyant material received in a same envelope.

18. A personal floatation device as defined in claim 14, wherein an attachment assembly is provided for releasably attaching said collar floatation member about the neck of the wearer.

19. A personal floatation device comprising a front floatation member adapted to generally overlay a wearer's chest region, a collar floatation member adapted to at least partly surround a neck region of the wearer, said collar floatation member being articulated to said front floatation member for relative movement with respect thereto between a first position wherein a front portion of said collar floatation member and said front floatation member are at least partly superposed one over the other so as to work in tandem to make use of the combined floatation capacity thereof, and a second position wherein said collar floatation member extends at an angle relative to said front floatation member to safely maintain the head of the wearer substantially above water, and a harness for attaching said front floatation member and said collar floatation member on the wearer's body, wherein said harness includes a waist belt, a back support adapted to overlay a lower back region of the wearer, said waist belt connecting said front floatation member to said back support, and a pair of groin straps adapted to extend between the legs of the wearer from said front floatation member to said back support.

20. A personal floatation device as defined in claim 19 wherein said back support is formed of a triangular piece of fabric material.

* * * * *